US012129086B2

(12) United States Patent
Bonnini

(10) Patent No.: US 12,129,086 B2
(45) Date of Patent: Oct. 29, 2024

(54) CONTAINER FOR COSMETIC PRODUCTS AND PRODUCTION METHOD THEREFOR

(71) Applicant: E'CLOSE S.R.L., Verona (IT)

(72) Inventor: Elisa Bonnini, Verona (IT)

(73) Assignee: E'CLOSE S.R.L., Verona (IT)

( * ) Notice: Subject to any disclaimer, the term of this patent is extended or adjusted under 35 U.S.C. 154(b) by 0 days.

(21) Appl. No.: 17/608,573

(22) PCT Filed: May 4, 2020

(86) PCT No.: PCT/IB2020/054209
§ 371 (c)(1),
(2) Date: Nov. 3, 2021

(87) PCT Pub. No.: WO2020/225707
PCT Pub. Date: Nov. 12, 2020

(65) Prior Publication Data

US 2022/0227526 A1 Jul. 21, 2022

(30) Foreign Application Priority Data

May 3, 2019 (IT) ..... 102019000006522

(51) Int. Cl.
*B65D 5/50* (2006.01)

(52) U.S. Cl.
CPC ..... *B65D 5/503* (2013.01); *B65D 5/5059* (2013.01)

(58) Field of Classification Search
CPC ..... B65D 81/133; B65D 5/5059; B65D 5/503
USPC ..... 206/433
See application file for complete search history.

(56) References Cited

U.S. PATENT DOCUMENTS 2,151,503 A * 3/1939 Dowst ..... B65D 5/5038 206/589
2,921,673 A * 1/1960 Ryan ..... B65D 85/60 206/459.5
3,286,834 A * 11/1966 English, Jr. ..... B65D 81/022 217/42
3,295,737 A * 1/1967 Page ..... B65D 25/00 D7/553.5
D264,420 S * 5/1982 Beckerman ..... D7/638
D266,147 S * 9/1982 McIntosh ..... D9/751
D268,167 S * 3/1983 Fox ..... D9/415
(Continued)

FOREIGN PATENT DOCUMENTS

EP 3 251 963 A1 12/2017
EP 3 461 755 A1 4/2019
WO WO 2018/02795 A1 1/2018

*Primary Examiner* — Ernesto A Grano
(74) *Attorney, Agent, or Firm* — Scully, Scott, Murphy & Presser, P.C.

(57) ABSTRACT

A container for perfumery or cosmetic products comprises a first box-shaped body delimiting a first compartment; a first tray, placed in the first compartment and comprising at least a first multi-laying cavity, of at least partial housing alternatively of at least a first or a second product of different shapes; a first tray cover which comprises a sheet applied to the first tray, the first tray cover surmounting a first part of said the cavity and defining an opening surmounting a second part of the first cavity; and an empty space being placed between the first tray cover and the first part of the first cavity and the opening crossing the thickness of the first tray cover completely.

8 Claims, 4 Drawing Sheets

(56) References Cited

U.S. PATENT DOCUMENTS

| | | | | | |
|---|---|---|---|---|---|
| 4,645,079 | A * | 2/1987 | Hill | B65D 1/36 | 206/370 |
| 4,711,348 | A * | 12/1987 | Schluger | B65D 5/509 | 206/459.5 |
| 4,739,353 | A * | 4/1988 | Heuer | B65D 85/38 | 206/316.1 |
| D299,007 | S * | 12/1988 | Laughner | D9/739 | |
| 5,209,349 | A * | 5/1993 | Porter | G09F 5/04 | 53/445 |
| D336,242 | S * | 6/1993 | Detert | D9/761 | |
| 6,112,900 | A * | 9/2000 | Adkins, Jr. | A61L 12/08 | 514/840 |
| 6,367,624 | B1 * | 4/2002 | Szczepanski | B65D 81/133 | 206/443 |
| 7,621,402 | B2 * | 11/2009 | Sandow | B65D 5/52 | 206/581 |
| 8,905,240 | B2 * | 12/2014 | Park | A45D 29/001 | 206/730 |
| 10,188,143 | B2 * | 1/2019 | Fath | A24F 15/00 | |
| D876,947 | S * | 3/2020 | Choi | D9/418 | |
| 11,052,021 | B2 * | 7/2021 | Marshall | B65D 75/54 | |
| 11,319,136 | B2 * | 5/2022 | Buzot | B65D 81/36 | |
| 11,375,785 | B2 * | 7/2022 | Tsai | A45C 13/30 | |
| 2006/0124504 | A1 * | 6/2006 | Rager | B65D 5/38 | 206/575 |
| 2011/0192751 | A1 * | 8/2011 | Doster | B65D 5/4233 | 206/514 |
| 2015/0375893 | A1 * | 12/2015 | Korinek | B29C 51/264 | 493/90 |
| 2017/0341805 | A1 * | 11/2017 | Al-Khal | B65D 5/5213 | |
| 2022/0177212 | A1 * | 6/2022 | Henigman | B65D 81/133 | |

* cited by examiner

CONTAINER FOR COSMETIC PRODUCTS AND PRODUCTION METHOD THEREFOR

CROSS-REFERENCE TO RELATED APPLICATIONS

This application claims priority to IT Patent Application No. 102019000006522 filed on May 3, 2019, and this application claims priority to and is a 371 of international PCT Application No. PCT/IB2020/054209 filed on May 4, 2020, the entire contents of which are hereby incorporated by reference.

TECHNICAL FIELD

The present invention relates to a container for perfumery or cosmetic products.

BACKGROUND ART

Containers are known for perfumery or cosmetic products of the type comprising a box-shaped body, inside which there is a plastic tray containing a cavity for the partial housing of the products.

Multi-laying trays are known to contain multiple cavities, each of which can alternatively contain a plurality of objects. This allows making an individual mold of the tray and use it for an entire set of boxes, instead of making one mold for each box.

The multi-laying trays therefore allow saving on mold costs.

DESCRIPTION OF THE INVENTION

The technical aim underlying the present invention is to devise a container for perfumery or cosmetic products able to allow a correct housing of the products and to make, at the same time, an elegant and pleasant package.

The technical aim and the specified objects are substantially achieved by a container comprising the technical characteristics set out in one or more of the following claims.

BRIEF DESCRIPTION OF THE DRAWINGS

Further characteristics and advantages of the present invention will appear clearer from the indicative, and therefore non-limiting description of a preferred, but not exclusive, embodiment of a container, as illustrated in the attached drawings in which.

EMBODIMENTS OF THE INVENTION

Figure 1:
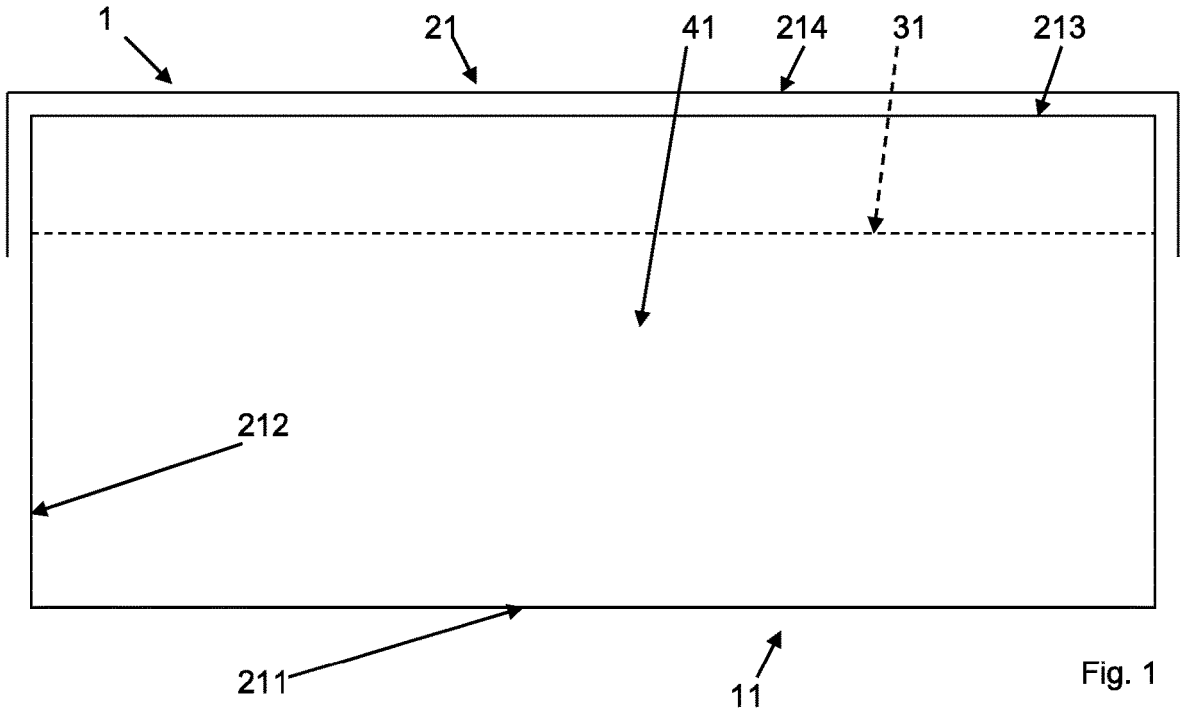
FIGS. 1 and 5 show containers according to the present invention.
Figure 2:
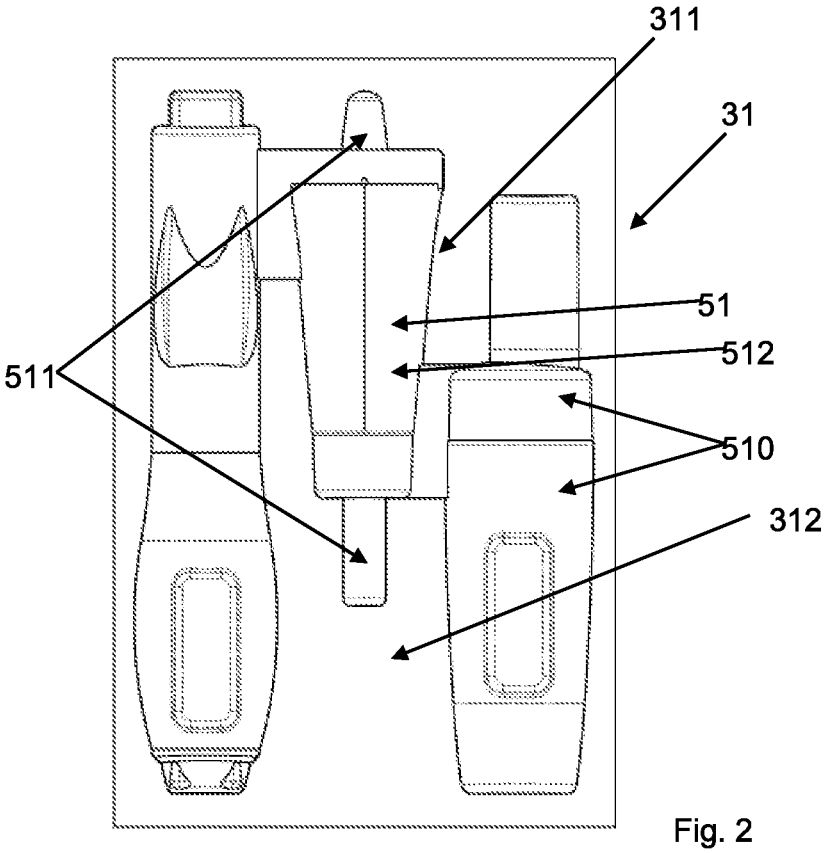
FIGS. 2 and 3 show components of a container according to the present invention or to be applied to a container according to the present invention.
Figure 3:
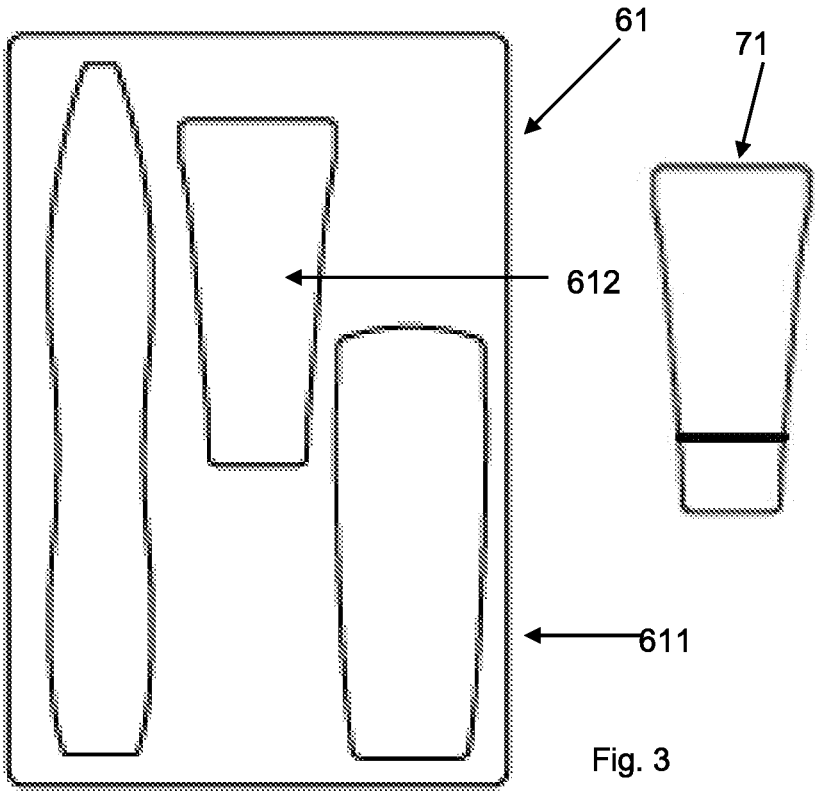
Figure 4:
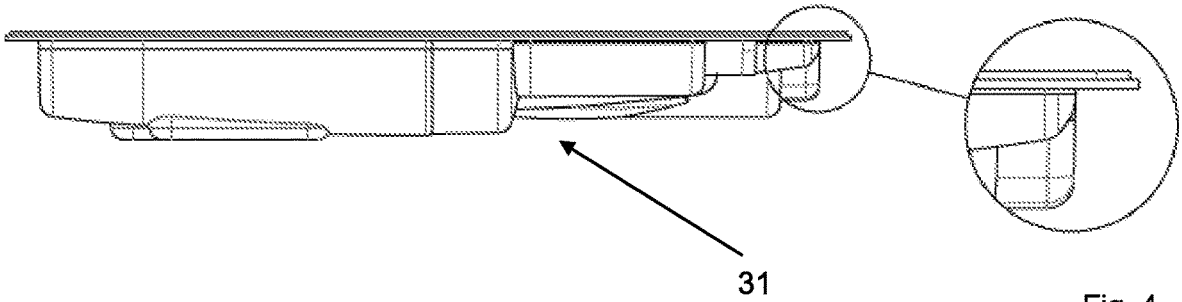
FIG. 4 shows a side view of the component in FIG. 3.
Figure 5:
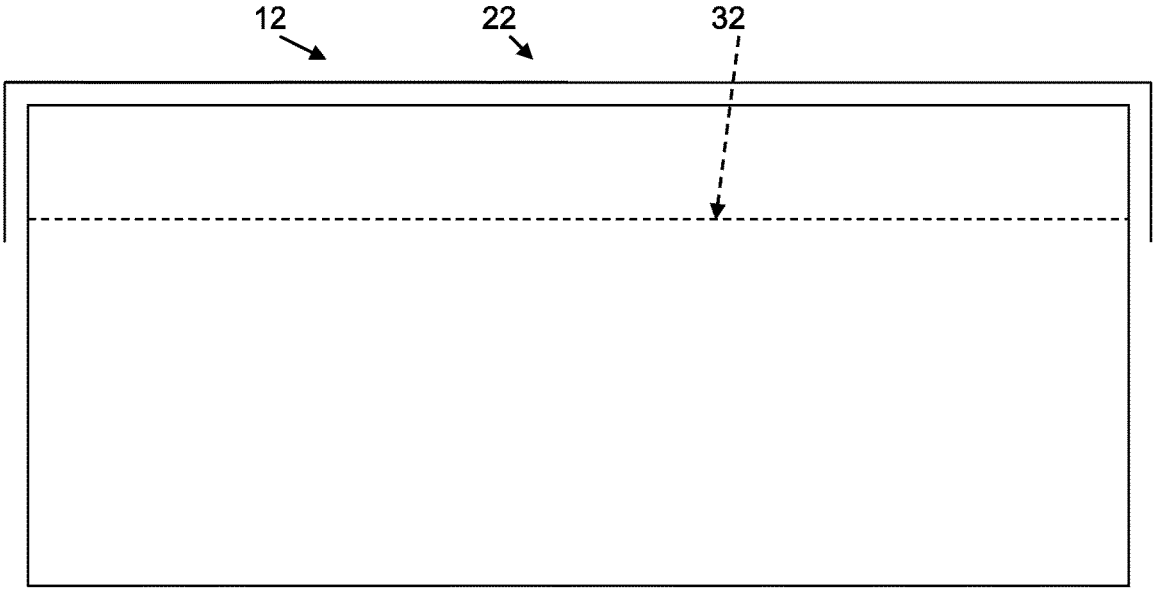
Figure 6:
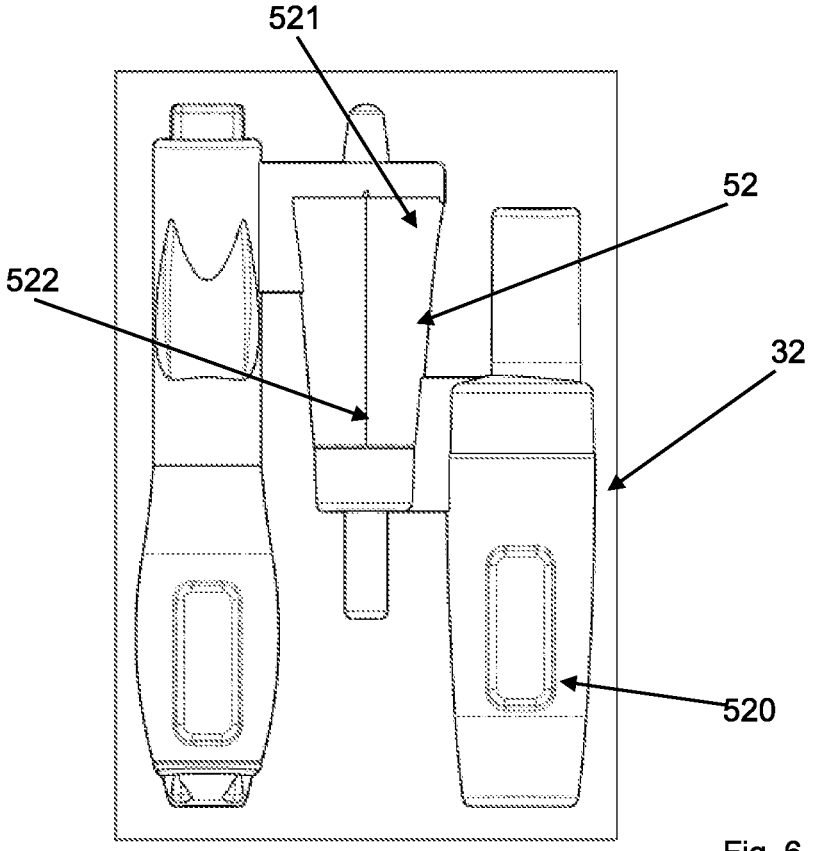
FIGS. 6 and 7 show components of a container according to the present invention or to be applied to a container according to the present invention.
Figure 7:
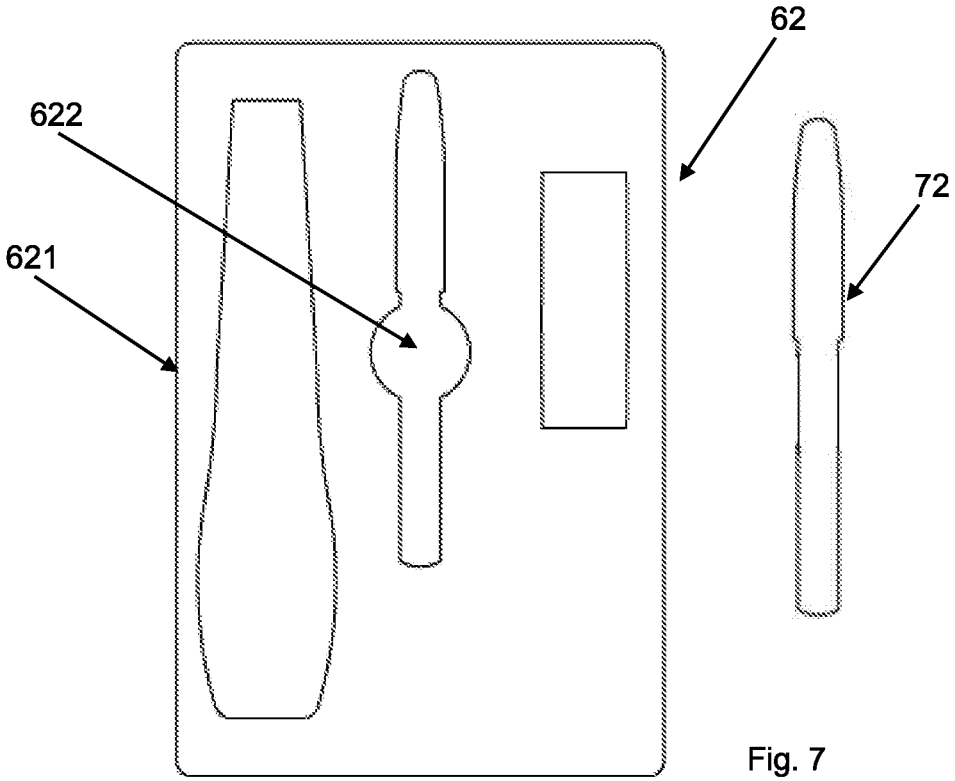

In the attached figures, reference numeral 1 globally indicates a container for perfumery or cosmetic products.

This container 1 comprises a first box-shaped body 21 delimiting a first compartment 41. The container 1 comprises a first tray 31, placed in said first compartment 41. The first tray 31 is appropriately a single monolithic body.

The first box-shaped body 21 can comprise e.g. a bottom 211, at least one side wall 212 (which extends transversely, orthogonally to the bottom).

The first box-shaped body 21 can comprise an access 213 to the first compartment 41. It is located on one side opposite the bottom 211. Appropriately, the first box-shaped body 21 can comprise a lid 214 that closes said access 213.

In an alternative embodiment that is not shown, the first box-shaped body 21 can have a side opening that allows the first tray 31 to be pulled out laterally (like a drawer).

The first tray 31 comprises at least a first cavity 51. The first tray 31, appropriately, comprises a flat area 312, from which the first cavity 51 extends.

The first cavity 51 is in a single monolithic body with the remaining parts of the first tray 31. The first cavity 51 is multi-laying, i.e. of at least partial housing alternatively of a first or of a second product of different shapes.

Appropriately, the first tray 31 is made of natural fibre material, e.g. paper material or comprising paper material. Specifically, the first tray 31 is made of paper pulp. If necessary, it can also be made of plastic or other material.

Appropriately, the first tray 31 comprises a plurality of cavities (including the first cavity 51). In particular, it has a plurality of multi-laying cavities.

An area surrounding the first cavity 51 is preferably flat.

From this flat area 312 the first cavity 51 extends towards the bottom 211. Appropriately, the flat area 312 surrounds at least the first cavity 51. Conveniently, the area placed between a plurality of cavities is flat.

The container 1 comprises a first tray cover 61, which is placed between said access 213 and the first tray 31. Appropriately, the first tray cover 61 comprises/is a sheet 611 applied to the first tray 31 (the sheet 611 can also consist of multiple layers/foils assembled together).

The sheet 611 is made of paper material, e.g. paper or cardboard.

It can have graphic signs or decorations that embellish the product. The first tray cover 61 is locked together with the first tray 31, in contact along an extended surface. The first tray cover 61 is therefore immovably connected to the first tray 31.

The first tray cover 61 surmounts a first part 511 of the first cavity 51 and defines an opening 612 surmounting a second part 512 of the first cavity 51.

This way the opening 612 allows viewing the product behind or the product to project itself outside the first cavity 51 through the first tray cover 61.

Similarly, the first tray cover 61 manages to cover at least part, or all parts, of the first cavity 51 which are not occupied by the first product 71.

This makes it possible to embellish the package by hiding the unused part of the multi-laying container. Conveniently, the first tray cover 61 is opaque or, anyway, not completely transparent.

Advantageously, the first and the second parts 511, 512 have different widths and/or depths.

Appropriately, an empty space is placed between the first tray cover 61 and the first part 511 of the first cavity 51. The opening 612 crosses the thickness of the first tray cover 61 completely.

The empty space placed between the first tray cover 61 and the first part 511 of the first cavity 51 has a variable volume depending on the specific application. Typically it is greater than 10% (appropriately greater than 25%) of the volume of the first cavity 51.

Appropriately, the first tray cover 61 comprises a first portion surmounting the first part 511 of the cavity 51 and contains an imaginary square of 1 $cm^2$.

The first tray cover 61 is conveniently connected to the tray 31 (in particular to the flat area of the first tray 31) by means of a layer of adhesive.

Advantageously, the first tray 31 comprises a second cavity 510.

What has been described with reference to the first cavity 51 can be repeated for the second cavity 510. In particular, the second cavity 510 is also multi-laying. The first tray cover 61 surmounts a part of said second cavity 510 and defines an additional opening that surmounts a further part of said second cavity 510.

The present invention also relates to a package 11.

This package 11 comprises a container 1 having one or more of the characteristics described above.

In addition, the package 11 comprises a first product 71 which is at least partly housed in said first cavity 51. Preferably, the first product 71 protrudes externally to the first cavity 51.

Appropriately, a portion of the first cavity 51, behind said first tray cover 61 and not occupied by the first product 71, remains empty.

The objective of the first tray cover 61 is, in fact, to hide the parts of the first cavity 61 not occupied by the first product 71.

At least one part of the perimeter of the opening 612 of the first tray cover 61 extends by overlapping on the perimeter of a port 311 of said first cavity 51. Preferably, the perimeter of the opening 612 of the first tray cover 61 overlaps by at least 30% of its length on the perimeter of the port 311.

In the preferred embodiment the first product 71 comprises a compressible bottle or tube containing a cream.

The present invention also relates to a set of packages.

This set comprises a first package 11 that has one or more of the technical characteristics described above.

The set also comprises a second package 12 comprising:

a second box-shaped body 22, advantageously identical in shape and/or in the material to the first box-shaped body 21;

a second tray 32.

The second tray 32 is identical in shape to the tray 31 and also the material can be the same. Appropriately, the second tray 32 is a single monolithic body.

The second tray 32 is placed in the second body-shaped box 22.

The second tray 32 comprises a multi-laying seat 52, which allows the alternative housing of the first and of a second product 71, 72.

The multi-laying seat 52 allows a stable positioning of the first and of the second product 71, 72.

Conveniently, the multi-laying seat 52 allows the alternative positioning of the first and of the second product 71, 72, placing the first and the second product parallel to the bottom of the box-shaped body 22.

The second product 72 is housed in the seat 52. The seat is identical in shape and size to the first cavity 51 (appropriately, the first and the second trays 31, 32 are also in the same material).

The second package 12 also comprises a second tray cover 62.

The second tray cover 62 comprises a sheet 621 applied to the second tray 32. This sheet 621 is appropriately made of paper material, e.g. paper or cardboard. The sheet 621 can also be an overlapping of several layers. It is usefully less than 3 mm thick.

The second tray cover 62 is immovably connected (glued) to the second tray 32. Appropriately, the second tray cover 62 is applied to a flat portion of the second tray 32.

The second tray cover 62 surmounts a first part 521 of the seat 52 and defines an opening 622 that surmounts a second part 522 of the seat 52.

An empty space is placed between the second tray cover 62 and the first part 521 of the seat 52. The second product 72 is housed in the second part 522 of the seat 52.

The opening 622 of the second tray cover 62 is different in shape or size or position to the opening 612 of the first tray cover 61.

The second tray 32 can comprise a second seat 520, also multi-laying. The second tray cover 62 can comprise an additional opening that surmounts the second seat 520 when said opening surmounts the seat 52.

When the second tray cover 62 is missing, the seat 52 is suitable for housing the first product 71, as an alternative to the second product 72.

The present invention also relates to a production method of a package having one or more of the characteristics described above with reference to the first package.

The method comprises the phases of:

assembling said first box-shaped body 21;

providing said first tray cover 61 comprising an opening 612, at least one part of the perimeter of the opening 612 of the first tray cover 61 corresponding to a first stretch of the perimeter of a port 311 of the first cavity 51;

providing a second tray cover 62 comprising an opening 622, different in shape and/or size and/or position to the opening 612 of the first tray cover 61;

assembling to said first tray 31 the first tray cover 61 and the first product 71, or the second tray cover 62 and the second product 72;

fitting the first tray 31 inside the first box-shaped body 21.

The present invention achieves important advantages.

First of all, it allows reducing the cost for making a set of packages. In fact, an individual mold can be used to make a plurality of packages intended to house different products.

The use of tray covers makes it possible to hide spaces from the end user's sight that are not occupied by the product in the tray (and that would be used to house an alternative product).

This way the same tray shape can always be used, which can be adapted to the specific needs by simply changing the shape of the tray cover.

The invention claimed is:

1. A package comprising:

a container for perfumery or cosmetic products, the container comprising:

a first box-shaped body delimiting a first compartment; and a first tray, placed in said first compartment and comprising at least a first multi-laying cavity, of at least partial housing alternatively of at least a first or a second product of different shapes;

a first tray cover which comprises a sheet applied to said first tray, said first tray cover surmounting a first part of said first cavity and defining an opening surmounting a second part of said first cavity; and an empty space being placed between the first tray cover and the first part of the first cavity and said opening crossing the thickness of the first tray cover completely; and a first product at least partly housed in said first cavity, at least one portion of the first cavity, behind said first tray cover and not occupied by the first product, remaining empty;

wherein the first tray cover covers all parts of the first cavity which are not occupied by the first product.

2. The container according to claim 1, wherein said sheet of the first tray cover is made of paper material.

3. The container according to claim 1, wherein said first tray is made of natural fiber.

4. The container according to claim 1, wherein the first tray cover comprises a first portion surmounting the first part of said first cavity and contains a square of 1 $cm^2$.

5. The package according to claim 1, wherein at least one part of the perimeter of the opening of the first tray cover extends by overlapping with the perimeter of a port of said first cavity.

6. The package according to claim 1, wherein the first product comprises a compressible bottle or tube containing a cream.

7. A set of packages comprising:

i) a first package, comprising:

a container for perfumery or cosmetic products, the container comprising:

a first box-shaped body delimiting a first compartment; and a first tray, placed in said first compartment and comprising at least a first multi-laying cavity, of at least partial housing alternatively of at least a first or a second product of different shapes;

a first tray cover which comprises a sheet applied to said first tray, said first tray cover surmounting a first part of said first cavity and defining an opening surmounting a second part of said first cavity; and an empty space being placed between the first tray cover and the first part of the first cavity and said opening crossing the thickness of the first tray cover completely; and a first product at least partly housed in said first cavity, at least one portion of the first cavity, behind said first tray cover and not occupied by the first product, remaining empty, ii) a second package comprising:

a second box-shaped body;

a second tray, identical in shape and size to the first tray, placed in the second body-shaped box and comprising a multi-laying seat wherein a second product is housed, said seat being identical in shape and size to the first cavity;

a second tray cover, comprising a sheet applied to said second tray, which surmounts a first part of said seat and defines an opening which surmounts a second part of said seat, said second product being housed in the second part of the seat; and an empty space being placed between said second tray cover and said first part of the seat, the opening of the second tray being different in shape and/or size to the opening of the first tray cover and, when the second tray cover is missing, the seat being suitable for housing the first product as an alternative to the second product.

8. A production method of a package comprising:

a container for perfumery or cosmetic products, the container comprising:

a first box-shaped body delimiting a first compartment; and a first tray, placed in said first compartment and comprising at least a first multi-laying cavity, of at least partial housing alternatively of at least a first or second product of different shapes;

a first tray cover which comprises a sheet applied to said first tray, said first tray cover surmounting a first part of said first cavity and defining an opening surmounting a second part of said first cavity; and an empty space being placed between the first tray cover and the first part of the first cavity and said opening crossing the thickness of the first tray cover completely; and a first product at least partly housed in said first cavity, at least one portion of the first cavity, behind said first tray cover and not occupied by the first product, remaining empty;

wherein the production method comprises the phases of:

i) providing said first tray cover comprising said opening, at least one part of the perimeter of the opening of the first tray cover corresponding to a first stretch of the perimeter of a part of the first cavity;

ii) providing a second tray cover comprising an opening, at least one part of the perimeter of the opening of the second tray cover being different in shape and/or size to the opening of the first tray cover; and iii) assembling to said first tray:

the first tray cover and the first product, positioning said first product in the first cavity; or the second tray cover and the second product, positioning the second product in the first cavity.

* * * * *